US006523314B1

(12) United States Patent
LaLonde et al.

(10) Patent No.: US 6,523,314 B1
(45) Date of Patent: Feb. 25, 2003

(54) CEILING GRID WITH RESILIENT CENTERING TABS

(75) Inventors: Paul D. LaLonde, Avon, OH (US); Brock Kavanagh, Avon, OH (US); Dennis Alvarez, Euclid, OH (US)

(73) Assignee: USG Interiors, Inc., Libertyville, IL (US)

( * ) Notice: Subject to any disclaimer, the term of this patent is extended or adjusted under 35 U.S.C. 154(b) by 0 days.

(21) Appl. No.: 09/752,179

(22) Filed: Dec. 29, 2000

(51) Int. Cl.[7] ..... E04B 5/52

(52) U.S. Cl. ..... 52/506.07; 52/729.5; 52/731.7; 52/733.1

(58) Field of Search ..... 52/506.07, 729.5, 52/731.7, 733.1, 769, 778

(56) References Cited

U.S. PATENT DOCUMENTS 3,000,474 A * 9/1961 Friedman et al.
3,207,057 A 9/1965 Brown et al.
3,304,684 A 2/1967 Mock et al.
3,320,713 A 5/1967 Downing, Jr.
3,342,515 A * 9/1967 Jahn
3,359,696 A 12/1967 Snaith
4,218,860 A * 8/1980 Av-Zuk
4,489,529 A * 12/1984 Ollinger et al.
4,492,066 A * 1/1985 LaLonde
4,679,375 A 7/1987 Shirey
4,712,350 A * 12/1987 Vukmanic
4,769,965 A 9/1988 Shaub
5,653,412 A * 8/1997 Martorano et al.
5,839,246 A * 11/1998 Ziegler et al.
6,315,428 B1 * 11/2001 Chiang

FOREIGN PATENT DOCUMENTS

GB 2147029 * 5/1985 ..... 52/506.07

* cited by examiner

*Primary Examiner*—Robert Canfield
(74) *Attorney, Agent, or Firm*—Pearne & Gordon LLP

(57) ABSTRACT

A grid tee for a suspended ceiling system having integral centering tabs to prevent misalignment of the tee in the space between adjacent ceiling tiles that could otherwise allow the edge of a tile to slip off a flange of the tee. The centering tabs are cut out of the web of the tee with a cantilevered free length that is sufficient to enable the tabs to deflect a relatively large fraction of the width of a flange portion without permanently bending whereby variations in the widths of tiles are accommodated without development of excessive forces which could otherwise cause the tabs to impale themselves into the edges of the tiles.

10 Claims, 6 Drawing Sheets

CEILING GRID WITH RESILIENT CENTERING TABS

The invention relates to suspended ceiling systems and, in particular, to improvements in grid structure for such systems.

BACKGROUND OF THE INVENTION

Narrow-faced grid tees for supporting ceiling boards or tiles have desirable aesthetic properties but can present problems in properly supporting the tiles. Currently produced ceiling tile is difficult to manufacture with precise dimensions and is susceptible to dimensional changes due to variation in moisture content as a result of humidity changes. It is possible for a grid tee to deflect laterally far enough to allow the edge of a tile, generally in the area of the mid-length of the tee, to drop down below the plane of the grid. This condition is to be avoided since it presents an unacceptable appearance. U.S. Pat. No. 4,679,375 illustrates two alternative designs for centering a grid tee between adjacent tiles. While these designs improve the performance of narrow-faced grid systems, they fall short of a fully satisfactory solution to the problem. In one design of this patent, integral centering tabs are stamped out of the web of the grid tee. These integral centering tabs are prone to locally crush the edges of the tile during original installation or later when the tile is removed and reinstalled for access to the plenum above the ceiling. When the tabs crush or otherwise impale themselves into the tile, they lose their centering function and leave the system again susceptible for a tile edge to drop off a flange. The other embodiment or design of the patent comprehends separate spring clips that snap over the grid tees and provide laterally diverging resilient legs that are compressed by engagement with the edges of adjacent tiles. The separate clips are undesirable because of their added costs and the uncertainty of proper installation in the field.

SUMMARY OF THE INVENTION

The invention provides an improved narrow-faced grid tee for a suspension ceiling system that reduces the risk of improper alignment between the tee and the tiles it supports. The grid tee thus avoids the unsightly dropping of a tile edge off of a flange of a misaligned tee. In accordance with the invention, the grid tee is formed with integral centering tabs that by their special configuration exhibit a resilient or spring-like character. The spring action of the tabs allows them to accommodate large variations in the size of the tile without either impaling themselves into the tiles or permanently bending or deforming out of a zone where they are effective for centering purposes. The geometry of the tabs achieves a surprising degree of resilience despite the typically relatively soft non-springy mild steel composition of the body of the tee.

Preferably, the grid tee is manufactured by roll-forming mild steel strip stock into a conventional tee configuration with a vertical web formed by a double layer of this strip stock. The resilient tab of the invention in the illustrated embodiments is shear cut out of the web on three sides of the tab profile leaving it integrally attached to the web at a fourth side. In this circumstance, the tab functions like a double leaf spring enabling its free end to deflect a relatively large distance without exceeding the yield point of the material. The two parts or leaves of the tab operate together to provide twice the resistance force available from one leaf but with a resilient deflection potential substantially greater than what would be possible with thicker material stock.

Each tab, ideally, has a spoon-like free end so that its cut edges are set inwardly of the laterally outermost portions of the tab to thereby avoid cutting into the edges of the tile when the tile is being installed or removed. While the tabs are preferably formed on both sides of the web, they are sufficiently longitudinally displaced from one another to avoid transmitting the forces on one tab directly to the adjacent tab on the opposite side of the web. This independent action of the tabs allow for greater predictability and control of the spring performance of the tabs.

The invention has utility in various other suspended ceiling grid systems where it is important to precisely control the horizontal position of a tile relative to the tees. Examples of other applications are so-called concealed grid systems where there is typically only a narrow supporting portion of a tile overlying the tee flange. The widths of the faces of the tees in such systems can be full or narrow, but in either case it is important to precisely control the position of a tile on the grid to prevent it from slipping off a flange.

DESCRIPTION OF THE PREFERRED EMBODIMENTS

Figure 1:
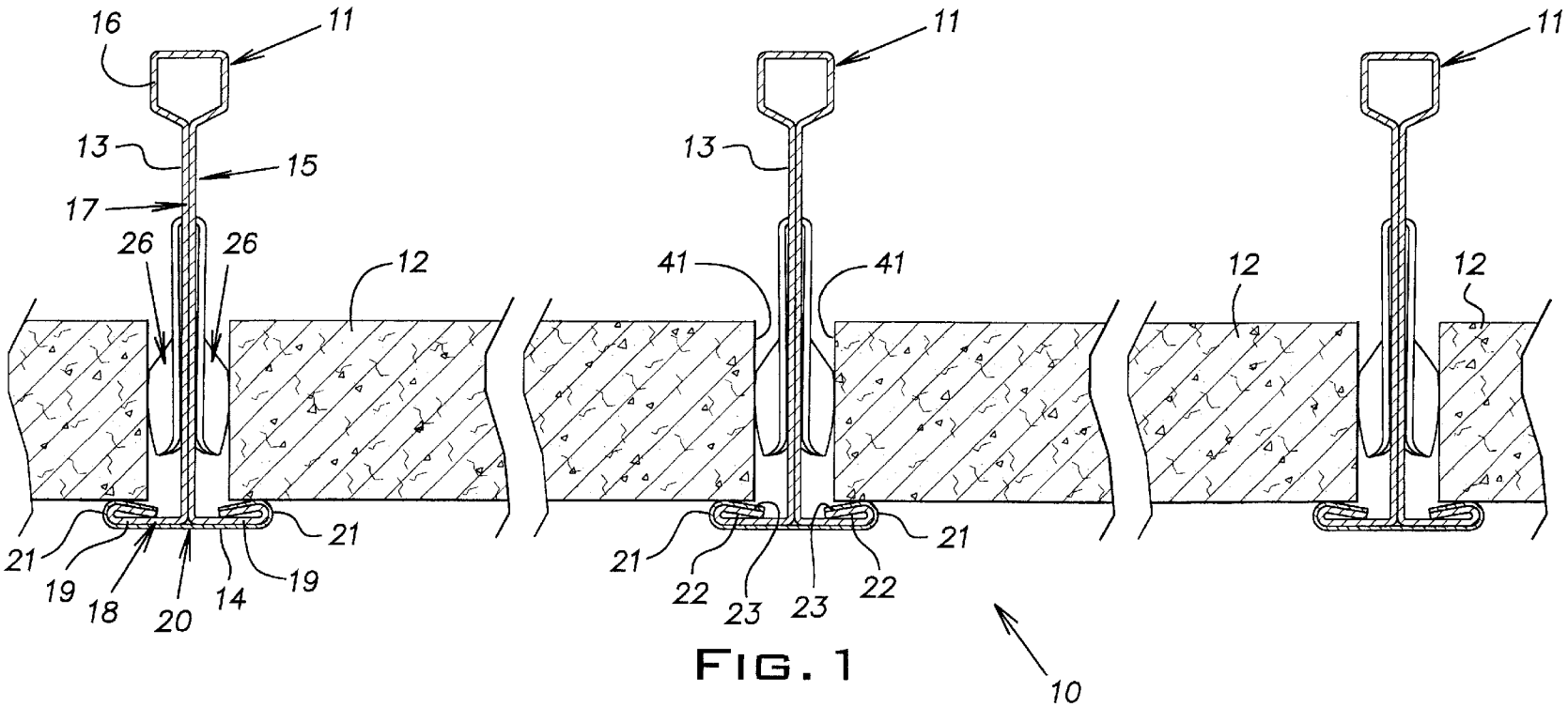
FIG. 1 is a fragmentary cross-sectional view of a suspension ceiling system incorporating a first embodiment of the invention.

A suspended ceiling system 10, as is typical, consists of grid tees 11 arranged in a rectangular array and ceiling tiles or boards 12 assembled on the tees. Cross tees perpendicular to the tees 11 shown in FIG. 1 are typically joined together at intersections with connectors assembled through slots in the tees as is well known in the industry. The rectangular array formed by the tees 11 ordinarily has nominal 2 foot by 2 foot or 2 foot by 4 foot patterns and the tiles 12 are sized to fit within these rectangular patterns in a customary manner. Usually, the grid tees 11 are suspended on wires or other means from an overhead structure above the ceiling system 10.

The tees 11 have elongated bodies preferably formed by rolling sheet metal stock into the desired cross-section. The illustrated tees 11 are formed of two separate sheets 13, 14, one forming a main body 15 and the other forming a cap 20.

The sheet 13 forming the main body 15 is mild steel, being relatively soft with a hardness of, for example, Rockwell B 60 or less. A suitable commercial steel is that satisfying ASTM A 366 97. In the illustrated examples, the main body sheet 13 has a thickness of between, for example, about 0.016 to 0.019 in. CS steel in a pre-painted condition. The cap sheet 14 can be of thinner material of, for example, between 0.006 to 0.010 in. pre-painted steel.

The main body sheet 13 is formed into a hollow reinforcing bulb 16 at the upper part of the tee 11. Below the bulb 16, the sheet forms a double wall or two layer vertical web 17. Adjacent a lower side of the tee 11, the main body sheet 13 forms a flange 18 with portions 19 extending laterally horizontally away from the web 17 in opposite directions. In the illustrated embodiment, the marginal areas of the flange portions 19 are folded on themselves to create a hem-like structure 22. The sheet 14 of the cap 20 has its margins similarly rolled over the distal edges or margins 22 of the main body flange portions 19 and forms the lower Visible face of the flange 18. The width of the flange 18 including the thickness of the sheet 14 of the cap 20 at both edges 21 is relatively narrow being, for example, about 9⁄16 in. wide.

Figure 2:
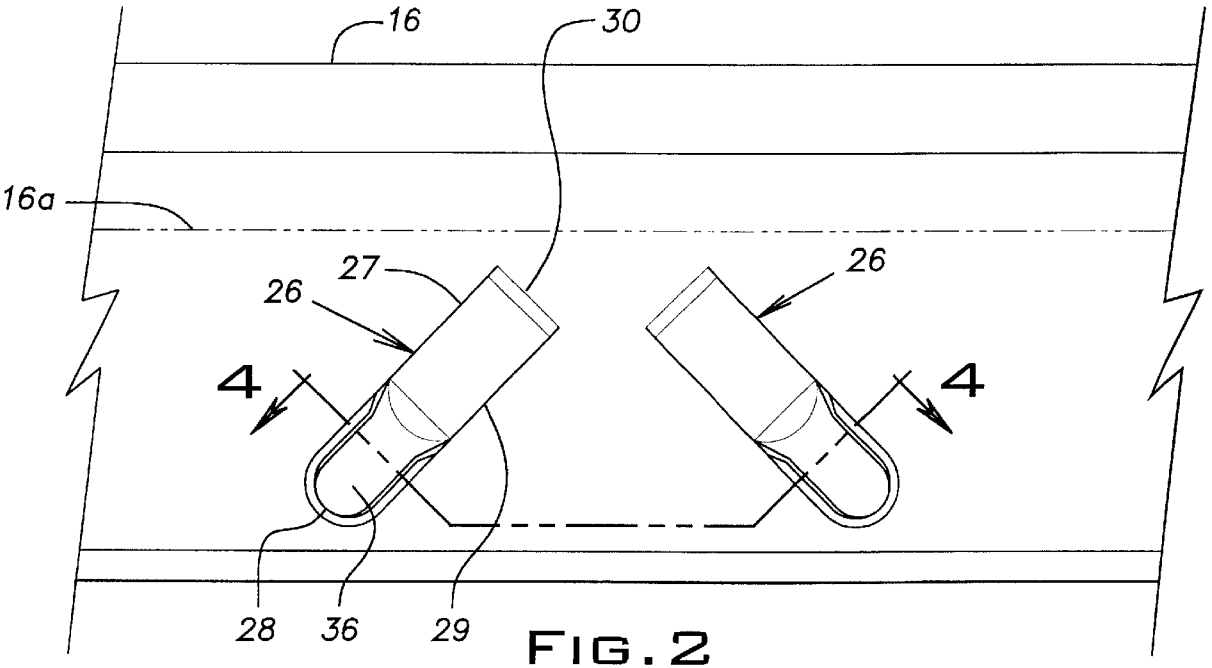
FIG. 2 is a fragmentary side elevational view of a portion of a grid tee in accordance with the first embodiment of the invention.
Figure 4:
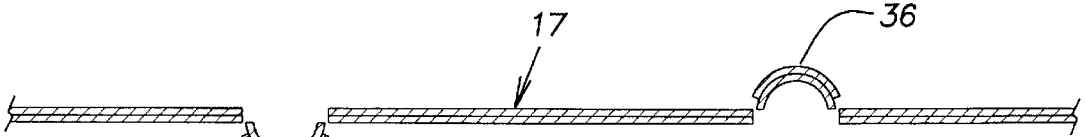
FIG. 4 is a fragmentary cross-sectional view of the grid tee of FIG. 2 taken along the broken line plane indicated by the lines 4—4 in FIG. 2.
Figure 3:
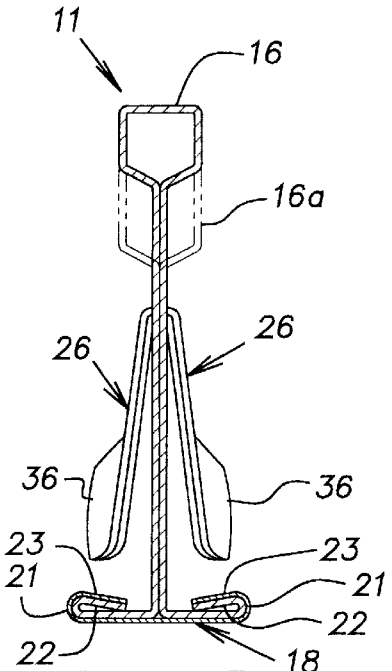
FIG. 3 is a cross-sectional view of the grid tee of FIG. 2.

As shown in FIG. 1, the tees 11 support the tiles or boards 12 on the upper faces of the flange portions 19 where they are wrapped by the margins 23 of the cap sheet 20. Under some circumstances, a tile can slip off an associated flange portion at the center of the length of a grid tee where the grid tee deflects laterally from a centered position between adjacent tiles. This can occur most frequently with tees having a narrow flange face and a 4 foot length. The invention provides centering means on the tees 11, in the form of integral spring elements 26, to maintain the tees centered between adjacent tiles 12, and thereby prevent an edge of a tile from slipping off a flange portion. FIGS. 2–4 illustrate a first embodiment of the centering means in the form of spring fingers or tabs 26 integrally formed on a tee 11. The tabs 26 are preferably grouped in adjacent identical pairs, one on each side of the web 17. FIG. 2 illustrates one pair of tabs 26; typically on a 4 foot long tee four pairs of tabs 26 are situated along the length of the tee at, for example, four spaced locations.

The tabs 26 which are finger or-leaf-like in structure are shear cut out of the web 17 on three sides 27, 28 and 29 and-remain attached on a fourth side 30. Each tab 26 has a length somewhat greater than its width and depends longitudinally downwardly from the attached side 30 so that its longitudinal direction is at an angle of about 450, for example, from the longitudinal horizontal direction of a tee. Adjacent pairs of the tabs 26 on opposite sides of the web 17 diverge downwardly in opposite directions with reference to the longitudinal direction of the tee 11. A tab 26 is similar in shape to a spoon having a bowl-shaped portion 36 at its free end distal from the attached side 30. This free bowl-shaped end 36 is convex at its face away from the web 17. In the illustrated example, the tab 26 has a cantilevered length of about 0.875 in. from its attached side 30 to the tip of its free end or side 28. Preferably, the tip of the free edge 28 is in-turned towards the web 17.

FIG. 3 illustrates the finger-like tabs 26 in their free state. It will be seen that adjacent their lower ends or edges 28 the tabs are spaced a distance from the web 17 that is a major fraction of the width of the underlying flange portion 19. By way of example, when the width of the flange is a nominal 9⁄16 in. (0.568 in.) the distance across a pair of tabs 26 at their maximum spread can be about 0.456 in. (measured across imaginary vertical planes tangent to the outwardmost portions of the bowl-shaped parts 36 of the tab 26).

The ceiling tiles 12 are installed in the conventional way of lowering them onto the grid tee flange portions 19 and are likewise removed in the conventional way by raising them off of these flange portions 19. During installation and removal, the tabs 26 slide on vertical faces 41 of the edges of the tiles 12. With reference to FIG. 1, the tabs 26 serve to center the respective grid tee 11 in the gap or space between adjacent ceiling tiles 12. This centering function reduces the risk that a tee 11 will laterally deflect towards one ceiling tile 12 and allow the edge of the adjacent tile to slip off the respective flange portion 19 and drop below the plane of the ceiling grid. Where the tabs 26 are angled from the vertical, in the view of FIG. 2, the tabs can be relatively long and still leave room for a relatively large reinforcing bulb, particularly in the vertical dimension, at the upper edge of the web 17. A large bulb **16*a* is diagrammatically illustrated in phantom in FIGS. 2 and 3**.

It has been found that, surprisingly, the tabs 26 exhibit a high degree of resilience or springiness despite being formed of the relatively soft parent of the grid tee main body sheet 13. This appears to be the result of the relatively long length of the tab 26 compared to its thickness and its two-layer construction. The resilience of the tabs 26 is important for several reasons. The tabs 26 can adjust to the actual dimensions of the ceiling tiles 12 without excessive forces being required to deflect the tabs. High force levels would otherwise cause the tabs 26 to impale themselves into the ceiling tiles and, consequently, their centering action would be lost. The relatively long lengths of the tabs 26 allows them to adjust through a large range of movement without plastically deforming, i.e. permanently bending. The convex shape of the spoon or bowl-shaped portion 36 of the tab 26 reduces the risk that the cut edges or sides 27–29 will slice into a ceiling tile 12 when the tile is installed or removed. Such severing action could otherwise defeat the ability of the tabs 26 to bear against the vertical faces 41 of the tiles 12 to produce the intended centering action.

Figure 5:
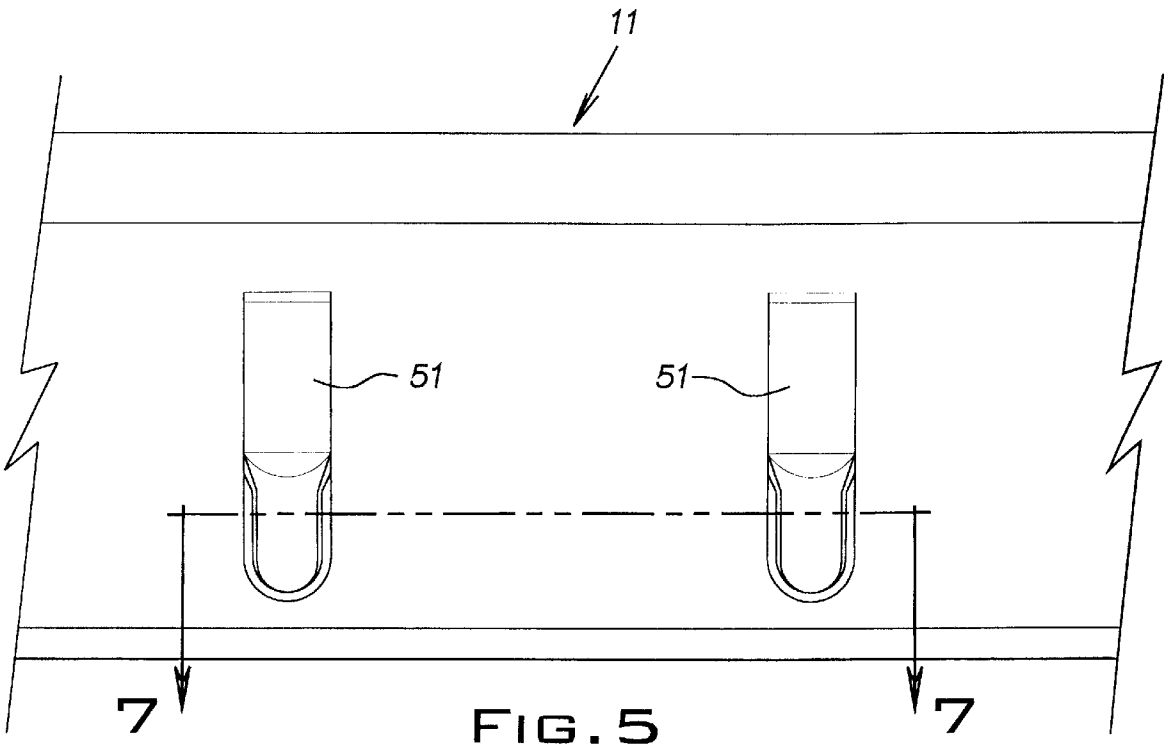
FIG. 5 is a fragmentary side elevational view of a portion of a grid tee in accordance with a second embodiment of the invention.
Figure 7:
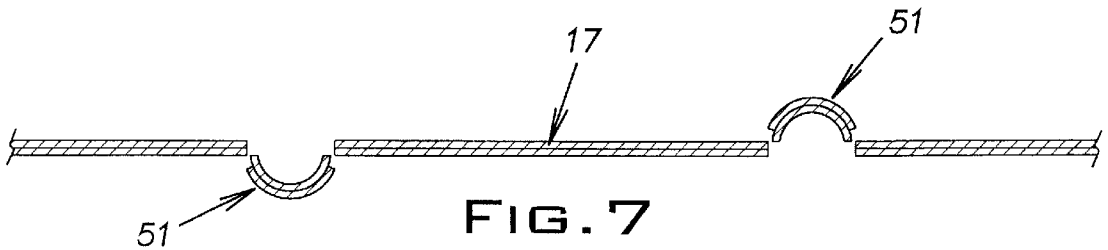
FIG. 7 is a fragmentary cross-sectional view of the grid tee of FIG. 5 taken along the plane indicated by the lines 7—7 in FIG. 5.
Figure 6:
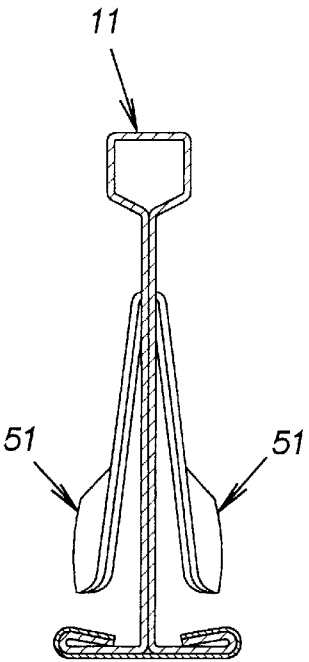
FIG. 6 is a cross-sectional view of the grid tee of FIG. 5.

FIGS. 5–7 illustrate a second embodiment of the invention. Parts identical to those described above in this and subsequently described embodiments are designated with the same numerals. Centering tabs 51 are cut out of the grid tee webs 17 with their longitudinal direction in a vertical orientation. In other respects, the tabs 51 are the same as the tabs 26 of the first embodiment of FIGS. 1–4.

Figure 8:
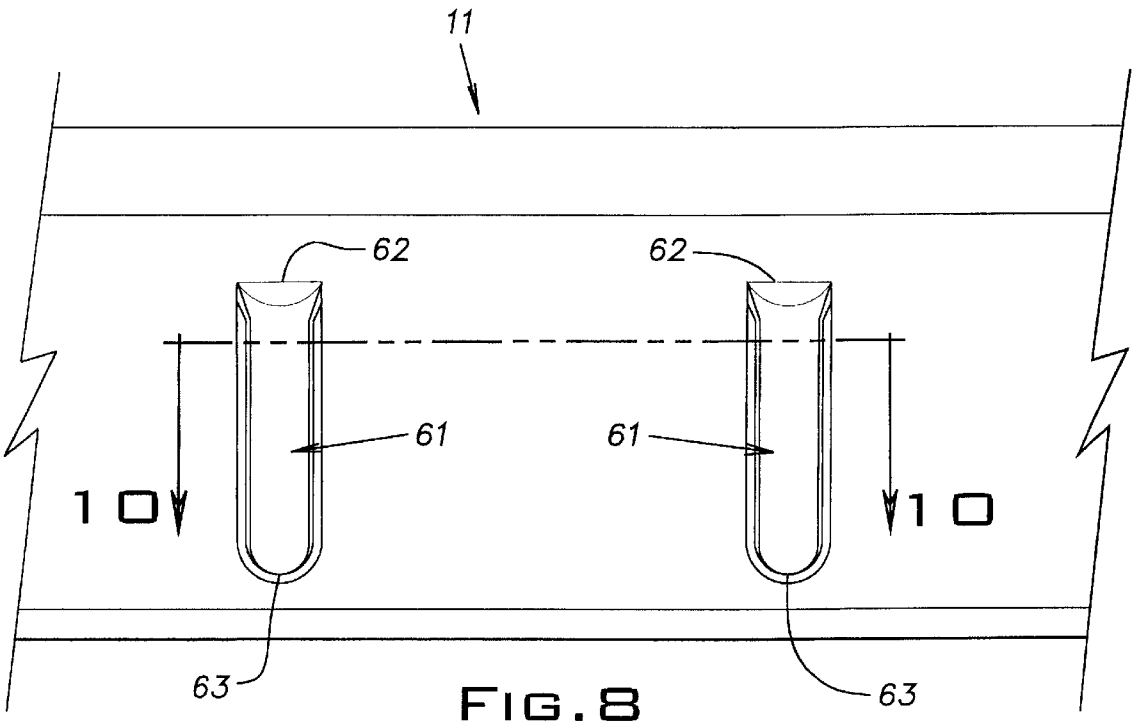
FIG. 8 is a fragmentary side elevational view of a portion of a grid tee in accordance with a third embodiment of the invention.
Figure 10:
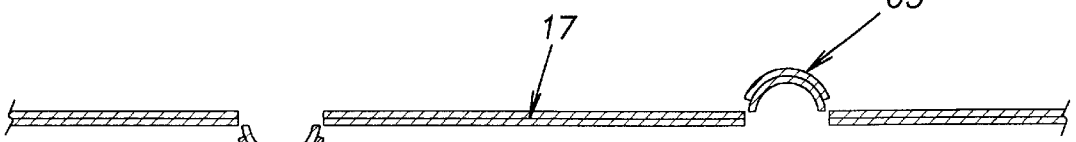
FIG. 10 is a fragmentary cross-sectional view of the grid tee of FIG. 8 taken along the plane indicated by the lines 10—10 in FIG. 8.
Figure 9:
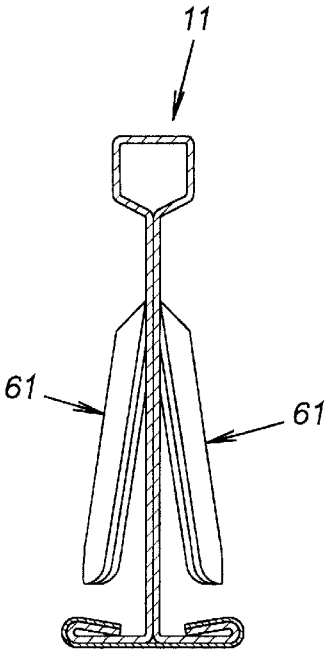
FIG. 9 is a cross-sectional view of the grid tee of FIG. 8.

FIGS. 8–10, illustrating a third embodiment of the invention, show centering tabs 61 that have a generally constant arcuate cross-section from a zone adjacent a side 62 where they are integrally attached to the web 17 to a distal free end 63. Like the earlier embodiments, adjacent the free end 63, the tabs 61 are bent inwardly slightly as shown in FIG. 9. Owing to their arched cross-section, the tabs 61 are relatively stiff and resiliently bend primarily in the area adjacent the side 62 at which they are attached to the web 17.

Figure 11:
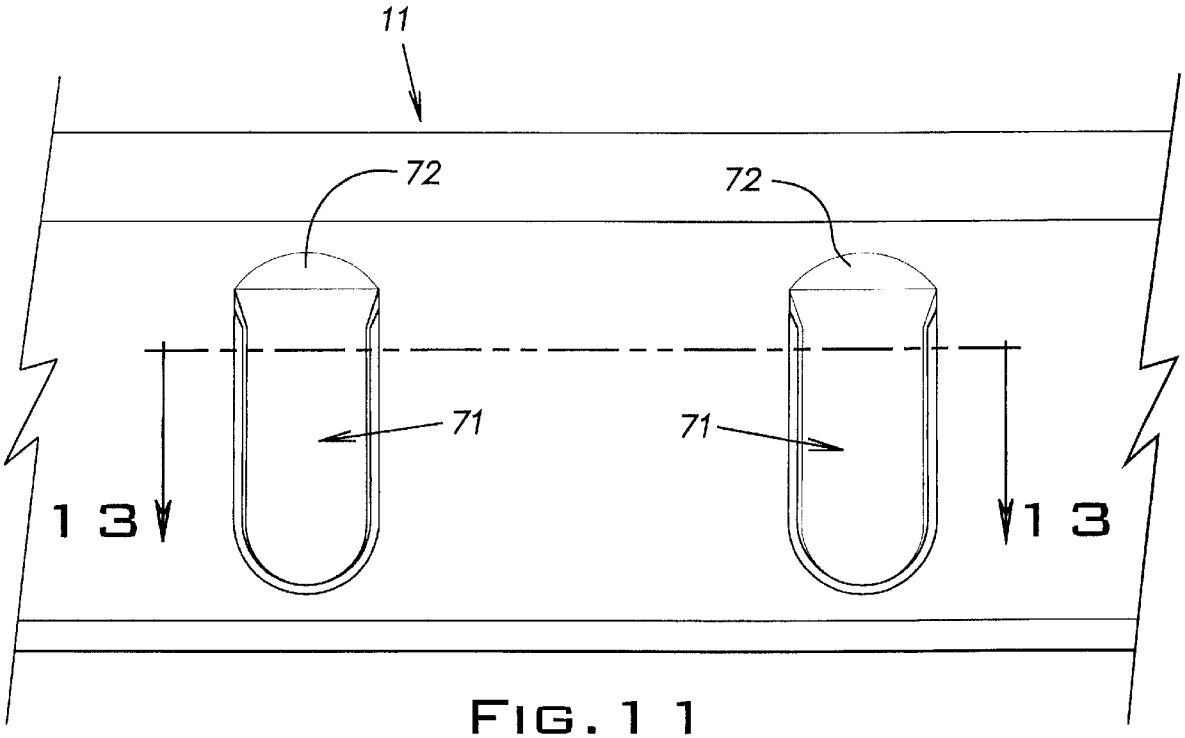
FIG. 11 is a fragmentary side elevational view of a portion of a grid tee in accordance with a fourth embodiment of the invention.
Figure 13:
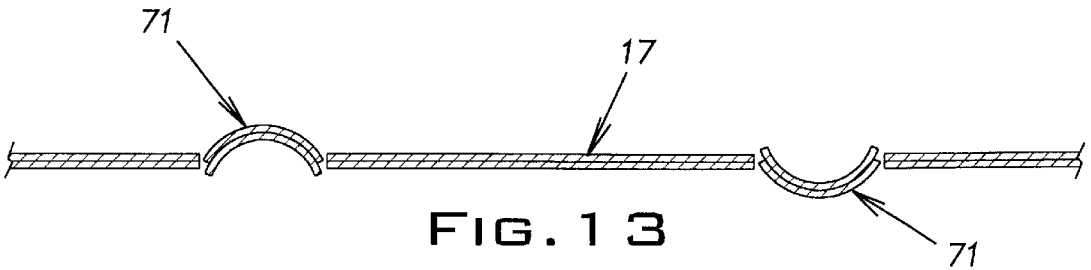
FIG. 13 is a fragmentary cross-sectional view of the grid tee of FIG. 11. taken along the plane indicated by the lines 13—13 in FIG. 11.
Figure 12:
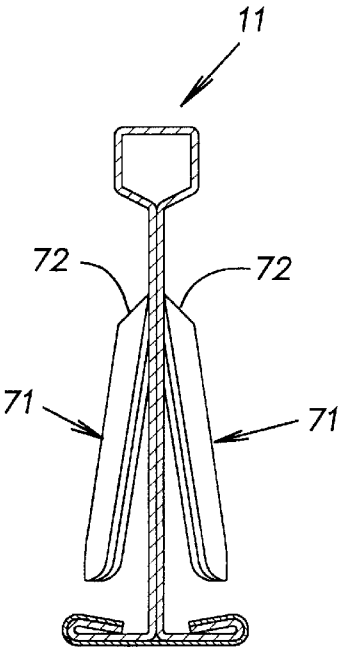
FIG. 12 is a cross-sectional view of the grid tee of FIG. 11.

FIGS. 11–13 illustrate a fourth embodiment of the invention. In this arrangement, centering tabs 71 have arcuate cross-sections along substantially their full free length. The tabs are attached to areas 72 of the web that are stamped into spherical-like segments to merge with the arched profile or cross-section of the tab.

Figure 15:
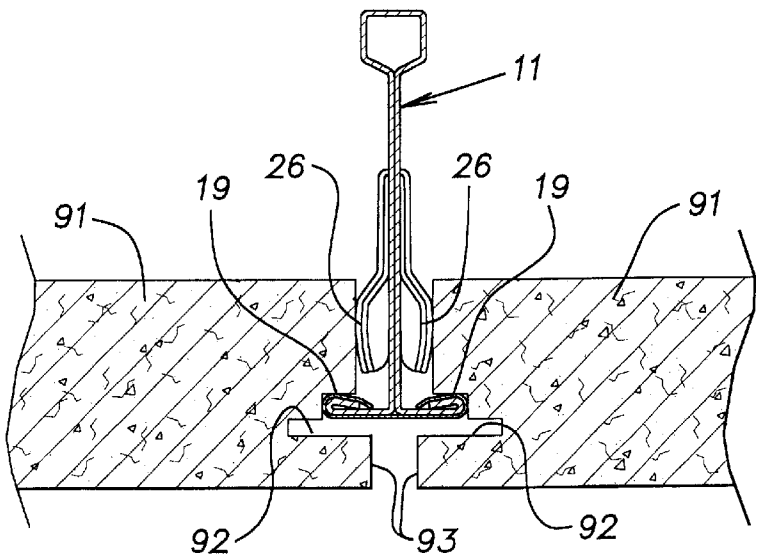
FIG. 15 is a fragmentary cross-sectional view of a suspension ceiling system in accordance with a sixth embodiment of the invention.
Figure 14:
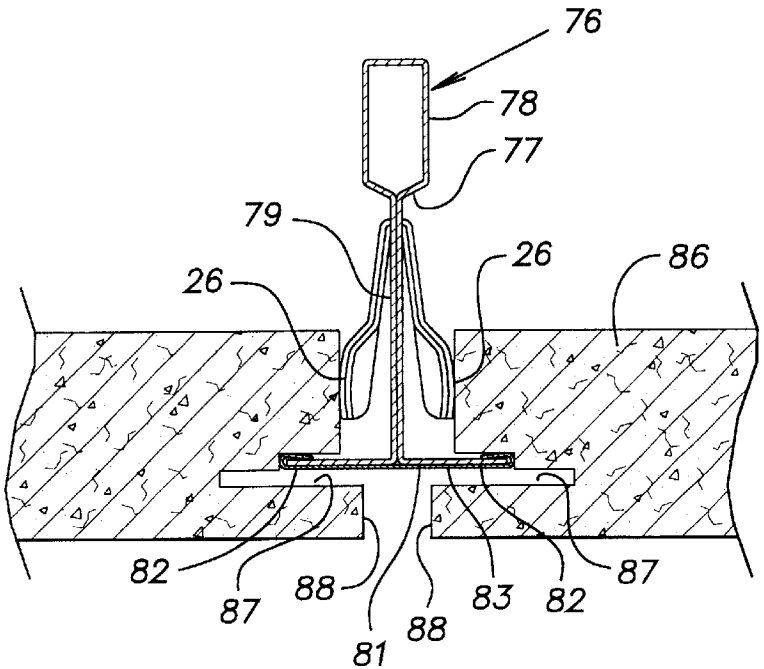
FIG. 14 is a fragmentary cross-sectional view of a suspension ceiling system in accordance with a fifth embodiment of the invention.

FIGS. 14 and 15 illustrate additional embodiments of the invention as applied to concealed grid systems. In FIG. 14, a grid tee or runner 76, like the previously described tees, has a main body metal sheet 77 rolled or otherwise formed into a hollow reinforcing bulb 78, a double-walled vertical web 79 and a flange 81 with horizontally divergent portions 82. A metal face cap 83 has its edges rolled over the edge areas of the flange portions 82. The width of the flange, compared to the previously described tees, is relatively wide, having a nominal width of, for example 15/16 inch.

Integral spring-like centering tabs 26, which can be the same as or similar to those described in connection with the embodiment of FIGS. 1–4, are formed on the web 79 at appropriate locations spaced along the tee 76. Tiles 86, having horizontal slots 87 formed on their vertical edge faces 88 are assembled on the tee 76 and other like cooperating tees. This is accomplished by shifting a tile 86 horizontally so that a part of an associated flange portion 82 is received in a slot 87, ultimately, as shown in FIG. 14. To enable installation and removal of a tile 86, the installed overlap condition of a tile edge over a flange portion 82 is necessarily limited. The spring acting centering tabs 26 serve to properly locate the tile 86 relative to the tee thereby reducing the risk that the tile will slip off the flange of a tee at the opposite edge of the tile.

FIG. 15 illustrates a concealed grid system utilizing a narrow-faced tee 11 that, for example, can be identical to the tee illustrated in FIGS. 1–4. The same numerals are used in this FIG. 15 to identify like parts. A tile 91 with a horizontal slot 92 in its vertical edge face 93 is assembled on a respective flange portion 19. As discussed in connection with FIG. 14, the spring-like centering tabs 26 serve to properly locate the tile 91 and thereby reduce the risk that it will slip off the tee supporting the opposite edge of the tile.

It will be seen that the disclosed embodiments of the centering tabs are all generally characterized by relatively long free lengths stamped or cut out of the body of the web and having convex configurations at least at their free ends. Additionally, the tabs are arranged in oppositely facing pairs with each tab being structurally and functionally independent of its paired tab.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A longitudinally extending grid tee having a lower flange extending generally horizontally, a web extending generally vertically upwardly from a center of the flange, and ceiling tile centering tabs integral with the web, the centering tabs being disposed on opposite sides of the web, the centering tabs having a cantilevered configuration with their width transverse to their length being somewhat less than their length such that they operate as resilient springs and are thereby enabled to resiliently deflect from a free configuration where they are situated laterally away from the web a distance that is at least a large fraction of a half width of the flange to a compressed position closer to the web than in the free configuration, said centering tabs serving to contact the vertical faces of the edges of ceiling tiles assembled on associated flanges and thereby center said grid tee between adjacent ceiling tiles regardless of normally expected variations in the sizes of said ceiling tiles, said tabs being cut out of said web along three sides to form a leaf-type spring structure.

2. A grid tee as set forth in claim 1, wherein said web is formed of a double layer of the same sheet material.

3. A grid tee as set forth in claim 2, wherein said web forming sheet material forms a reinforcing hollow bulb at and centered on an upper edge of the web.

4. A longitudinally extending grid tee having a lower flange extending generally horizontally, a web extending generally vertically upwardly from a center of the flange, a hollow reinforcing bulb on an upper edge of the web and ceiling tile centering tabs integral with the web, the centering tabs being disposed on opposite sides of the web, the centering tabs having a cantilevered configuration that enables them to resiliently deflect from a free configuration where they are situated laterally away from the web a distance that is at least a large fraction of a half width of the flange to a compressed position closer to the web than in the free configuration, said centering tabs serving to contact the vertical faces of the edges of ceiling tiles assembled on associated flanges and thereby center said grid tee between adjacent ceiling tiles regardless of normally expected variations in the sizes of said ceiling tiles, said tabs in their free configuration extending laterally outwardly beyond said bulb.

5. A longitudinally extending grid tee having a lower flange extending generally horizontally, a web extending generally vertically upwardly from a center of the flange, and ceiling tile centering tabs integral with the web, the centering tabs being disposed on opposite sides of the web, the centering tabs having a cantilevered configuration that enables them to resiliently deflect from a free configuration where they are situated laterally away from the web a distance that is at least a large fraction of a half width of the flange to a compressed position closer to the web than in the free configuration, said centering tabs serving to contact the vertical faces of the edges of ceiling tiles assembled on associated flanges and thereby center said grid tee between adjacent ceiling tiles regardless of normally expected variations in the sizes of said ceiling tiles, said tabs having a side attached to the web, said tabs having free ends remote from said attached sides, said free ends being convex on a face facing away from said web.

6. A grid tee as set forth in claim 5, wherein said tabs depend downwardly from said attached side.

7. A grid tee as set forth in claim 5, wherein said tabs depend laterally outwardly from said attached side away from said web.

8. A grid tee as set forth in claim 5, wherein said tabs are grouped in pairs, one of each pair being disposed on one side of the web and the other of said each pair being disposed on the opposite side of the web.

9. A grid tee for a suspended ceiling system comprising an elongated body made of roll-formed sheet stock, the body having an upper hollow reinforcing bulb, a double web below the bulb and oppositely directed flange portions extending generally perpendicularly to the web at the lower edge of the web, the bulb, web and flange portions all being formed of a single sheet, and finger-like centering tabs integral with the web and formed by cutting their sides from the web, the centering tabs being disposed on opposite sides of the web, the configuration of the tabs being arranged to afford them with sufficient resilience to enable them to engage the vertical faces of the edges of ceiling tiles supported on the flange portions and center the grid tee between the faces of adjacent tiles without developing a resistance to deflection that would otherwise tend to cause the tabs to impale themselves into the tiles and thereby lose their centering function, the tabs having a free length from a point of attachment with the web that exceeds the combined width of said flange portions.

10. A grid tee for a suspended ceiling having an upper reinforcing bulb, a vertical web attached to and below the bulb and a horizontal flange attached to and below the web, the grid tee being roll-formed of sheet metal stock, the web being generally planar and being formed with integral centering tabs struck out of its body, the centering tabs being disposed on opposite sides of the web and in a free state overlying an associated flange portion and extending laterally outwardly away from the web over a major portion of the width of the underlying associated flange portion, the tabs each having a configuration enabling it to act as a resilient spring when contacted by a ceiling tile assembled on the adjacent underlying flange portion, the tabs having parts distal from the web, the resilience of the tabs enabling the tabs to center the grid tee between adjacent ceiling tiles while reducing the risk that the tabs will locally crush the material of the tile to an appreciable extent and thereby lose their ability to center the tee.

* * * * *